US010293228B1

(12) United States Patent
Kaminsky, Jr.

(10) Patent No.: US 10,293,228 B1
(45) Date of Patent: May 21, 2019

(54) WOODEN BASEBALL BAT

(71) Applicant: Robert Joseph Kaminsky, Jr., Homer Glen, IL (US)

(72) Inventor: Robert Joseph Kaminsky, Jr., Homer Glen, IL (US)

( * ) Notice: Subject to any disclaimer, the term of this patent is extended or adjusted under 35 U.S.C. 154(b) by 0 days.

(21) Appl. No.: 15/797,111

(22) Filed: Oct. 30, 2017

(51) Int. Cl.

| | |
|---|---|
| ***A63B 59/52*** | (2015.01) |
| ***A63B 71/00*** | (2006.01) |
| *A63B 59/56* | (2015.01) |
| *A63B 59/50* | (2015.01) |
| *A63B 59/51* | (2015.01) |

(52) U.S. Cl.
CPC ..... *A63B 59/52* (2015.10); *A63B 71/0054* (2013.01); *A63B 59/50* (2015.10); *A63B 59/51* (2015.10); *A63B 59/56* (2015.10); *A63B 2071/0072* (2013.01)

(58) Field of Classification Search
CPC ..... A63B 59/50; A63B 59/52; A63B 59/56; A63B 59/51
USPC ..... 473/564, 566
See application file for complete search history.

(56) References Cited

U.S. PATENT DOCUMENTS

| | | | | | |
|---|---|---|---|---|---|
| 1,603,904 | A * | 10/1926 | Cohn | A63B 59/50 | 473/519 |
| 4,103,412 | A * | 8/1978 | Krieger | A63B 59/50 | 29/460 |
| 5,165,686 | A * | 11/1992 | Morgan | A63B 59/52 | 473/564 |
| 2010/0081525 | A1* | 4/2010 | Dobransky | A63B 59/50 | 473/564 |
| 2012/0108370 | A1* | 5/2012 | Pope | A63B 59/50 | 473/564 |
| 2017/0165545 | A1* | 6/2017 | Chang | A63B 59/54 | |

* cited by examiner

*Primary Examiner* — Benjamin Layno
(74) *Attorney, Agent, or Firm* — Wood, Phillips, Katz, Clark & Mortimer

(57) ABSTRACT

A baseball bat having a body with spaced ends, a barrel region at one end and a handle region at the other end. A safety assembly has an elongate member that extends through at least a part of the body and is connected at spaced first and second locations to the body. The elongate member is operable to at least momentarily exert a restraining force on a fragmented part of the barrel region to thereby avoid unimpeded movement of the fragmented part of the barrel region away from the handle region.

20 Claims, 3 Drawing Sheets

WOODEN BASEBALL BAT

BACKGROUND OF THE INVENTION

Field of the Invention

This invention relates to baseball bats and, more particularly, to baseball bats made from wood.

Background Art

Since baseball began, bats have been made from wood. Commonly, the bats are made using maple or ash.

Non-wooden bats have been developed, with aluminum bats used at many levels, including in youth leagues and in colleges. There has been controversy surrounding the use of non-wooden bats, given their perceived propensity to dangerously propel struck baseballs. In Major League competition, league rules and unions have controlled bat construction and, at this stage in the U.S., Major League bats are made only from wood stock.

There is a further controversy that has been brewing regarding the particular wood from which bats can be made. Many players prefer the performance characteristics of maple bats. However, maple bats have come into focus because they are prone to breaking upon striking a baseball pitched at high speeds.

Due to the shape of bats, with an enlarged barrel region and a narrow handle region, when such breakage occurs, part or all of the barrel tends to fully separate from the handle. When the bat breaks in this manner, swing momentum will cause the barrel, or fragments thereof, to be propelled significant distances at potentially high speeds onto the playing field or into surrounding areas that are occupied by fans and other attendees at the event. In recent years, injuries and "close calls" resulting from bats fracturing have caused those involved in the game to consider either replacing wooden bats or incorporating safeguards that might prevent injuries to, or potentially death of, players and onlookers.

One attempted solution has been to provide a supplemental connection between the handle and barrel regions with the objective being that if there is a fracturing of the bat wood, the handle and barrel will be held together. Some recent research has been focused upon coating the external surface of the bat in a manner that will maintain the handle and barrel closely together, even if there is a complete fracture of the wood between these regions.

This approach, while potentially effective in terms of eliminating a projectile from the bat handle, creates a different potential danger for the player him/herself. That is, the binding coating may create a hinge for the barrel fragment, causing it to abruptly snap back towards the player. Consequently, this approach, while potentially protecting other players and onlookers, does not address the safety of those individuals wielding the bat.

The reality is that in spite of the long history of baseball, and the use of wooden bats, no feasible solution has been arrived at to reduce or eliminate the dangers associated with bats broken during play. This is true in spite of the fact that numerous injuries have occurred resulting from broken bats and many more are likely to occur given the dangerous nature of the bat fragments which may potentially become heavy and sharp, fast moving projectiles.

The industry continues to seek out solutions to this problem so that those playing the game may continue to use wooden bats, and particularly those made from materials prone to breaking in use.

SUMMARY OF THE INVENTION

In one form, the invention is directed to a baseball bat having a body with spaced ends, a barrel region at one end and a handle region at the other end. A safety assembly has an elongate member that extends through at least a part of the body and is connected at spaced first and second locations to the body. The elongate member is operable to at least momentarily exert a restraining force on a fragmented part of the barrel region to thereby avoid unimpeded movement of the fragmented part of the barrel region away from the handle region.

In one form, the elongate member is in a slackened state with the body of the baseball bat intact.

In one form, the body has an opening extending fully between the spaced ends and the first and second locations reside one each at the spaced ends of the body.

In one form, the body is made from wood.

In one form, the body opening extends fully through the body and the spaced ends of the body.

In one form, the elongate member has an enlargement at the one end of the body that is blocked from moving through the body opening.

In one form, the elongate member has another enlargement at the other end of the body that is blocked from moving through the body opening.

In one form, the elongate member has an enlargement at the one end of the body that is outside of the opening and blocked from moving into and through the opening at the one end of the body.

In one form, the elongate member has another enlargement at the other end of the body that is outside of the opening and blocked from moving into and through the opening at the other end of the body.

In one form, the elongate member is an elongate wire.

In one form, the elongate wire has a flexible configuration.

In one form, the elongate member is in the form of a single strand.

In one form, the elongate member has a braided construction.

In one form, the elongate wire is coiled within the body opening.

In one form, the elongate wire is placed in a slackened state within the body opening.

In one form, the elongate wire has a length within the opening that is greater than a distance between the spaced ends of the body.

In one form, the elongate wire is made from metal.

In one form, the elongate wire is made with a material that will elongate substantially before rupturing under a tensile load.

In one form, the elongate wire is made from a non-metal material.

In one form, the handle region has a knob at the other end of the body.

DETAILED DESCRIPTION OF THE PREFERRED EMBODIMENT

Figures 1, 2, 4, 5:
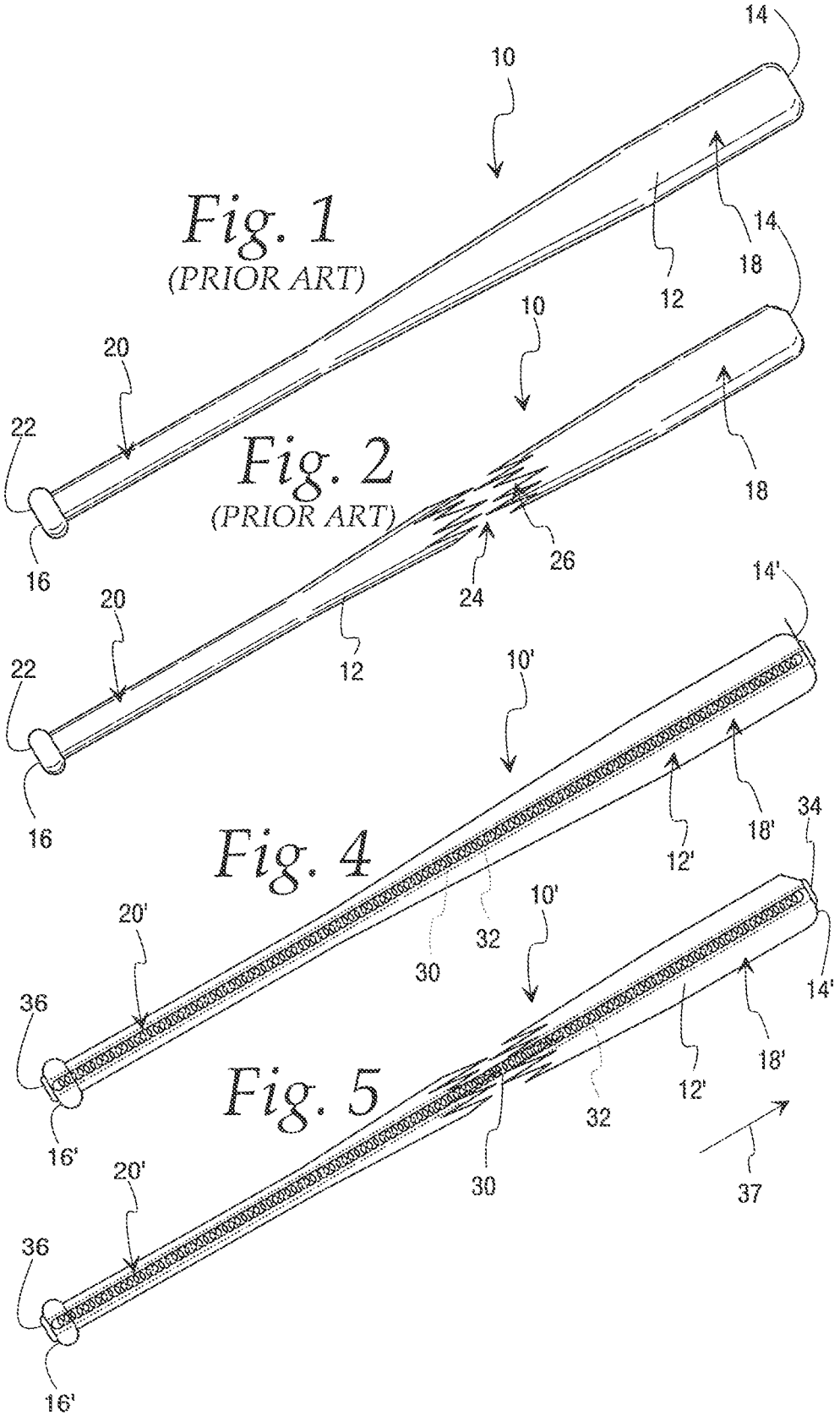
Fig. 1 (PRIOR ART)
Fig. 2 (PRIOR ART)
FIG. 1 is a perspective view of a conventional baseball bat.
FIG. 2 is a view as in FIG. 1 wherein the body of the bat is fractured, as from striking a baseball.
FIG. 4 is a perspective view of a specific form of bat, as shown in FIG. 3, wherein the safety assembly is in the form of a coiled elongate member.
FIG. 5 is a view as in FIG. 2 wherein the bat in FIG. 4 is fractured.

In FIGS. 1 and 2, a conventional wooden baseball bat is shown at 10. The bat 10 has a body 12 with spaced ends 14, 16. A barrel region 18 is provided at the one end 14, with a handle region 20 provided at the other end 16. A knob 22 is provided at the end of the handle region 20.

When a baseball is struck with the bat at the barrel region 18, the impact upon the mass of the barrel region 18, that is large compared to that of the handle region 20, may cause bending of the body 12 in a manner that makes the likelihood of fracture, as shown at 24 in FIG. 2, quite high. A complete fracture will allow the barrel region 18 of the body 12 to be projected through the momentum of the user's swing. As noted above, this is particularly dangerous given the speed at which the fractured barrel region 18 might be projected. Further, the fracture normally produces a jagged edge 26 that could actually cause penetration of the skin of somebody impacted thereby, which, coupled with the weight of the traveling barrel region 18, could result in serious injury or, in a worse case, death.

Figure 3:
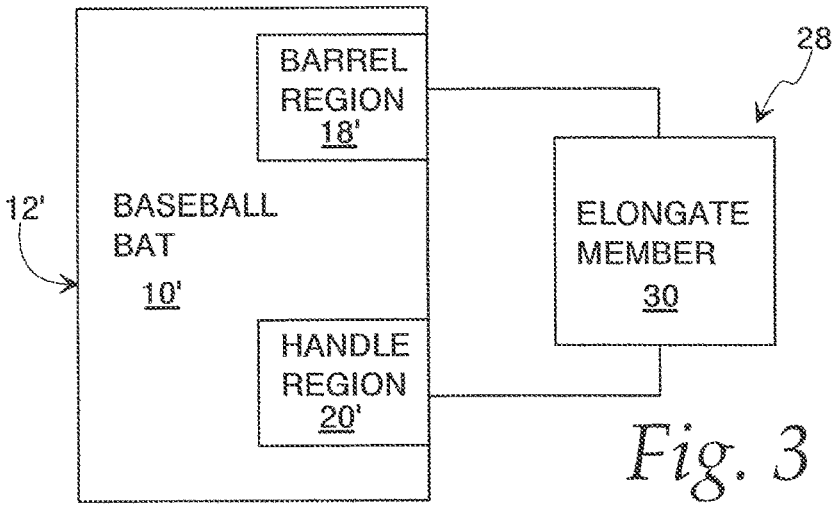
FIG. 3 is a schematic representation of a baseball bat incorporating a safety assembly, in the nature of an elongate member, according to the invention.

To control travel of the fragmented/separated barrel region once the body 12 is fractured, the invention contemplates the incorporation of a safety assembly, as shown schematically in FIG. 3 at 28. The safety assembly 28 consists of an elongate member 30, such as a wire or rod, that is connected at spaced locations on the body 12' of the baseball bat 10' having the barrel and handle regions 18', 20'. The spaced locations may be any two locations that bridge across an anticipated fracture site, for reasons that will be explained hereinbelow.

More specifically, as shown in FIGS. 4-7, the inventive bat 10' utilizes an elongate member 30 that is connected to the barrel region 18' and handle region 20' at the ends 14', 16' of the body 12'.

In this embodiment, the elongate member 30 resides in an opening 32 that extends fully through the body 12' between the ends 14', 16'. At the end 14', the elongate member 30 is joined to an enlargement 34 that cannot pass into or through the opening 32. A similar type enlargement 36 is connected to the elongate member 30 at the end 16' and is likewise configured so that it cannot pass into or through the opening 32 at the body end 16'.

It should be understood that the invention contemplates any type of anchoring of the elongate member at spaced locations that bridge across an anticipated fracture zone. The depicted manner of connecting the elongate member 30 at spaced locations is but exemplary in nature.

In this embodiment, within the opening 32, the elongate member 30 is coiled. With the elongate member 30 uncoiled, it has a length substantially greater than the distance between the body ends 14', 16'.

As shown in FIG. 5, once the bat 10' fractures, the barrel region 18' tends to move away from the handle region 20' generally in the direction of the arrow 37 in FIG. 5. As the barrel region 18' continues to travel after fracture, the elongate member 30 uncoils. It is preferred that once the elongate member 30 is fully uncoiled, its length is such that the fractured barrel region 18' resides a safe distance away from the batter so that there is little likelihood that he/she will be struck by the same. At the same time, it is desired that the travel be confined so that the barrel region 18' does not contact others on or around the playing field.

Figure 6:
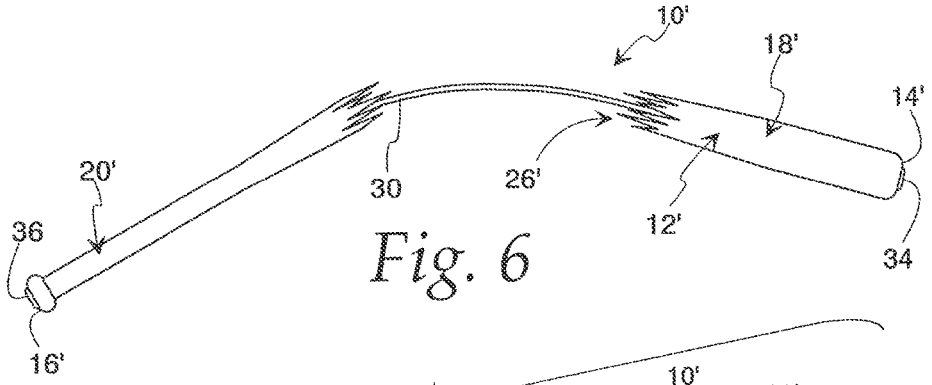
FIG. 6 is a view as in FIG. 5 wherein a barrel region of the bat is moved further away from a handle region of the bat than in FIG. 5.

The invention contemplates principally two different ways that the elongate member 30 might function. As shown in FIG. 6, the elongate member 30 might stay intact so that it thereby acts as a tether to eventually confine travel of the barrel region 18' relative to the handle region 20' to a distance dictated by the length of the elongate member in its uncoiled state.

Figure 7:
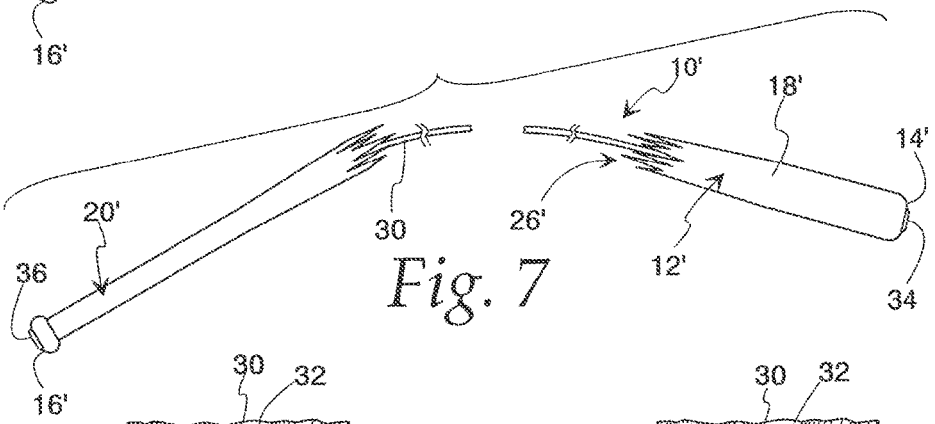
FIG. 7 is a view as in FIG. 6 wherein the elongate member has been ruptured under the force of the projecting barrel region.

Alternatively, once the elongate member 30 is uncoiled, it will exert a momentary restraining force upon the barrel region 18' to avoid unimpeded movement of the fragmented barrel region 18' away from the handle region 20'. The elongate member 30 can be designed so that this restraining force is only momentarily applied and ultimately the elongate member 30 will snap under the tensile force exerted thereon, as shown in FIG. 7. At the point the elongate member 30 breaks, it will have at least slowed the travel speed of the barrel region 18' away from the handle region 20', Ideally, this will allow the barrel region 18' to land safely a distance away from the batter but not so far away as to come in contact with other players or bystanders.

Figure 8:
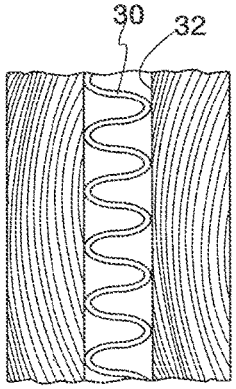
FIG. 8 is a fragmentary, cross-sectional view of a part of a bat body with an elongate member, according to the invention, in one form in a slackened state in an opening therein.

The elongate member 30 may be placed within the opening 32 in a number of different ways. As shown in FIG. 8, as an alternative to coiling the elongate member 30, the elongate member 30 can be pre-formed in a wave pattern that allows the elongate wire 30 to extend between the body ends 14', 16' with the ability to extend to a length greater than the distance between the ends 14', 16'.

Figure 9:
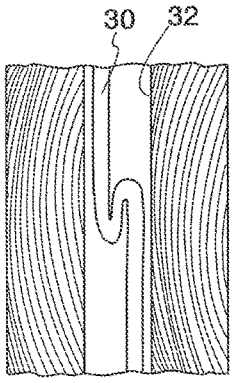
FIG. 9 is a view as in FIG. 8 showing another manner of putting in place an elongate member to be in a slackened state.

As an alternative, as shown in FIG. 9, the elongate wire 30 may be tucked into the opening 32 so that it may be extendible to a length greater than it occupies in the unfractured bat 10'.

The configurations of the elongate member 30 in each of FIGS. 5, 8, and 9 represent different ways that the elongate member 30 may be placed in the opening 32 in a slackened state.

Figure 11:
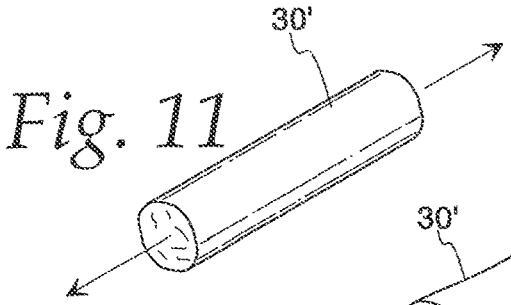
FIG. 11 is an enlarged, fragmentary, perspective view of a portion of the elongate member, as in FIG. 10, under an applied tensile load.
Figure 12:
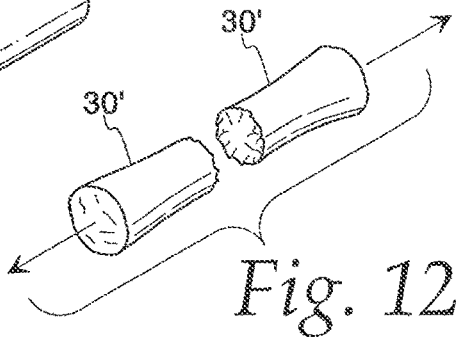
FIG. 12 is a view as in FIG. 11 wherein the elongate member has failed under the tensile loading.
Figure 10:
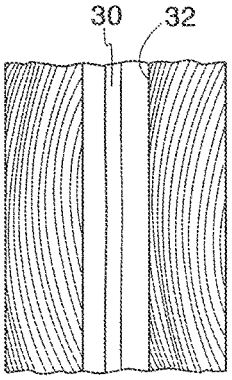
FIG. 10 is a view as in FIGS. 8 and 9 showing a further modified form of elongate member that is assembled in a substantially straight arrangement between the bat body ends.

Alternatively, as shown in FIGS. 10-12, a modified form of elongate member 30' may be made with a substantially straight length within the opening 32. In the event of bat fracture, the elongate member 30' placed under tension as shown in FIG. 11, may elongate substantially to achieve the objective of tethering the fractured barrel region so that it may not move beyond the extended length of the elongate member 30'.

Alternatively, as shown in FIG. 12, the elongate member 30' may only momentarily exert a restraining force on the fragmented barrel region, with the elongate member 30' eventually breaking under a predetermined tensile load, as shown in FIG. 12.

At least in those embodiments wherein an elongate wire is slackened with the bat intact, it is preferred that the elongate member have a highly flexible construction such that it can readily bend and be readily collapsed and extended to assume different effective lengths.

Figure 14:
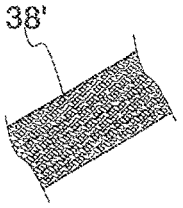
FIG. 14 is a view as in FIG. 13 wherein the elongate member is made from a braided strand material.
Figure 13:
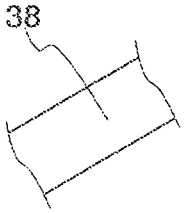
FIG. 13 is a fragmentary view of one form of elongate member made from a single strand of material.

As shown in FIGS. 13 and 14, the elongate member may be in the form of a wire 38 that has a single strand, as shown in FIG. 13, or a braided arrangement as shown at 38' in FIG. 14.

The elongate member/wire may be made from metal or a non-metal material.

Figure 15:
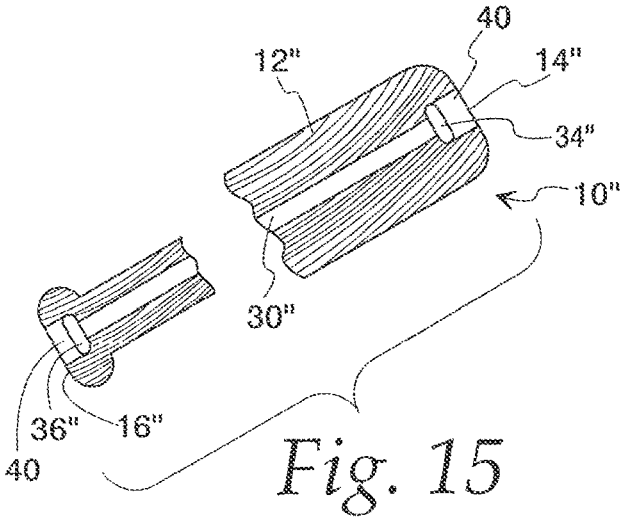
FIG. 15 is a fragmentary, cross-sectional view of a bat, according to the present invention, and having a modified form of safety assembly.

In FIG. 15, portions of a bat 10" are shown wherein an elongate member 30" is connected at spaced locations on the body 12" through enlargements 34", 36" that are recessed away from their respective ends 14", 16". Filler 40 may be used to occupy a void that is formed to produce the recessed arrangement.

The foregoing disclosure of specific embodiments is intended to be illustrative of the broad concepts comprehended by the invention.

The invention claimed is:

1. A baseball bat comprising:

a body having spaced ends, a barrel region at one end and a handle region at the other end; and a safety assembly comprising an inelastic elongate member that extends through at least a part of the body and is connected at spaced first and second locations to the body, the inelastic elongate member operable to at least momentarily exert a restraining force on a fragmented part of the barrel region to thereby avoid unimpeded movement of the fragmented part of the barrel region away from the handle region, the inelastic elongate member is configured so that the fragmented part of the barrel region is allowed to move separately and away a predetermined distance from the handle region with the inelastic elongate member staying intact.

2. The baseball bat according to claim 1 wherein the body is made from wood and the inelastic elongate member is made from a metal material.

3. The baseball bat according to claim 1 wherein the inelastic elongate member is an elongate wire.

4. The baseball bat according to claim 3 wherein the elongate wire has a flexible configuration that allows the wire to be readily bent and collapsed and extended to assume different effective lengths.

5. The baseball bat according to claim 4 wherein the body has an opening and the elongate wire has a length within the body opening that is greater than a distance between the spaced ends of the body.

6. The baseball bat according to claim 3 wherein the inelastic elongate member comprises a single strand.

7. The baseball bat according to claim 3 wherein the elongate wire is made from metal.

8. The baseball bat according to claim 3 wherein the elongate wire is made with a material that will elongate substantially before rupturing under a tensile load.

9. The baseball bat according to claim 3 wherein the elongate wire is made from a non-metal material.

10. The baseball bat according to claim 3 wherein the handle region comprises a knob at the other end of the body.

11. A baseball bat comprising:

a body having spaced ends, a barrel region at one end and a handle region at the other end; and a safety assembly comprising an elongate member that extends through at least a part of the body and is connected at spaced first and second locations to the body, the elongate member operable to at least momentarily exert a restraining force on a fragmented part of the barrel region to thereby avoid unimpeded movement of the fragmented part of the barrel region away from the handle region, wherein the elongate member is in a slackened state with the body of the baseball bat intact.

12. The baseball bat according to claim 11 wherein the body has an opening extending fully between the spaced ends and the first and second locations reside one each at the spaced ends of the body.

13. The baseball bat according to claim 12 wherein the body opening extends fully through the body and the spaced ends of the body.

14. The baseball bat according to claim 13 wherein the elongate member has an enlargement at the one end of the body that is blocked from moving through the body opening.

15. The baseball bat according to claim 14 wherein the elongate member has another enlargement at the other end of the body that is blocked from moving through the body opening.

16. The baseball bat according to claim 13 wherein the elongate member has an enlargement at the one end of the body that is outside of the opening and blocked from moving into and through the opening at the one end of the body.

17. The baseball bat according to claim 16 wherein the elongate member has another enlargement at the other end of the body that is outside of the opening and blocked from moving into and through the opening at the other end of the body.

18. A baseball bat comprising:

a body having spaced ends, a barrel region at one end and a handle region at the other end; and a safety assembly comprising an elongate member that extends through at least a part of the body and is connected at spaced first and second locations to the body, the elongate member operable to at least momentarily exert a restraining force on a fragmented part of the barrel region to thereby avoid unimpeded movement of the fragmented part of the barrel region away from the handle region, wherein the elongate member is an elongate wire, wherein the elongate wire has a flexible configuration, wherein the elongate member wire has a braided construction.

19. A baseball bat comprising:

a body having spaced ends, a barrel region at one end and a handle region at the other end; and a safety assembly comprising an elongate member that extends through at least a part of the body and is connected at spaced first and second locations to the body, the elongate member operable to at least momentarily exert a restraining force on a fragmented part of the barrel region to thereby avoid unimpeded movement of the fragmented part of the barrel region away from the handle region, wherein the elongate member is an elongate wire, wherein the elongate wire has a flexible configuration, wherein the body has an opening and the elongate wire is coiled within the body opening.

20. A baseball bat comprising:

a body having spaced ends, a barrel region at one end and a handle region at the other end; and a safety assembly comprising an elongate member that extends through at least a part of the body and is connected at spaced first and second locations to the body, the elongate member operable to at least momentarily exert a restraining force on a fragmented part of the barrel region to thereby avoid unimpeded movement of the fragmented part of the barrel region away from the handle region, wherein the elongate member is an elongate wire, wherein the elongate wire has a flexible configuration, wherein the boy has an opening and the elongate wire is placed in a slackened state within the body opening.

* * * * *